US008789522B2

(12) United States Patent
Padgett

(10) Patent No.: US 8,789,522 B2
(45) Date of Patent: Jul. 29, 2014

(54) BROIL BURNER

(75) Inventor: Michael Padgett, Austin, KY (US)

(73) Assignee: Electrolux Home Products, Inc., Cleveland, OH (US)

( * ) Notice: Subject to any disclaimer, the term of this patent is extended or adjusted under 35 U.S.C. 154(b) by 706 days.

(21) Appl. No.: 12/481,157

(22) Filed: Jun. 9, 2009

(65) Prior Publication Data

US 2010/0307474 A1 Dec. 9, 2010

(51) Int. Cl.
*F24B 5/08* (2006.01)

(52) U.S. Cl.
USPC ..... 126/1 R; 126/1 AD; 126/41 R; 126/41 A; 99/401; 99/385

(58) Field of Classification Search
USPC ..... 126/1 R, 1 AD, 41 R, 41 A, 15 R, 25 R, 126/39 J; 99/401, 385, 447, 451, 444; 432/31
See application file for complete search history.

(56) References Cited

U.S. PATENT DOCUMENTS 2,102,482 A * 12/1937 Parker ..... 126/41 R
2,507,920 A * 5/1950 McCormick ..... 219/486
2,844,702 A 7/1958 Staats
3,010,383 A * 11/1961 Greene ..... 99/332
3,322,112 A * 5/1967 Huff et al. ..... 126/41 R
3,357,475 A * 12/1967 Schweitzer ..... 126/41 R
3,360,028 A 12/1967 Saponara et al.
3,529,582 A * 9/1970 Hurko et al. ..... 126/21 R
3,593,647 A * 7/1971 Copeland, Jr. ..... 99/339
3,638,634 A * 2/1972 Bolitho ..... 126/41 R
3,870,031 A * 3/1975 Kruper ..... 126/39 J
4,020,323 A 4/1977 Dills
4,112,912 A * 9/1978 Ballentine ..... 126/41 R
4,416,249 A * 11/1983 Reynolds et al. ..... 126/41 R
4,598,691 A 7/1986 Herrelko et al.
5,078,121 A 1/1992 Ha
5,121,676 A * 6/1992 Jurgens ..... 99/340
5,473,980 A * 12/1995 Carpenter ..... 99/446
5,609,039 A * 3/1997 Green et al. ..... 62/457.3
6,337,466 B1 * 1/2002 Chasen ..... 219/405
7,267,544 B2 9/2007 Spangrud
2008/0134441 A1 * 6/2008 Johnson ..... 5/690

* cited by examiner

*Primary Examiner* — Avinash Savani
(74) *Attorney, Agent, or Firm* — Pearne & Gordon LLP

(57) ABSTRACT

A cooking apparatus includes a cooking cavity and a heat source located within the cooking cavity. A shield is mounted relative to the heat source wherein the shield includes at least one side edge with an undulating pattern. The undulating pattern is configured to deflect heat from the heat source to different sections of the cooking cavity to provide a substantially uniform distribution of heat within the cooking cavity.

13 Claims, 3 Drawing Sheets

BROIL BURNER

FIELD OF THE INVENTION

The present invention relates generally to a cooking appliance and facilitates cooking of a food item.

BACKGROUND OF THE INVENTION

Cooking apparatuses generally provide heat to a cooking cavity. Some locations within the cooking cavity, such as different portions of a rack, can often be much warmer than other locations, resulting in an unbalanced distribution of heat. The unbalanced distribution of heat results in users either undercooking or overcooking certain food items, such as hamburgers, that are being cooked in the cooking apparatus.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a cooking apparatus is provided. The cooking apparatus includes a cooking cavity and a heat source located within the cooking cavity. A shield is mounted relative to the heat source wherein the shield includes at least one side edge with an undulating pattern. The undulating pattern is configured to deflect heat from the heat source to different sections of the cooking cavity.

In accordance with another aspect of the present invention, a cooking apparatus is provided. The cooking apparatus includes a cooking cavity and a heat source located within the cooking cavity, the heat source having a longitudinal axis. A shield is mounted relative to the heat source and includes a first side edge and a second side edge opposite the first side edge. The first and second side edges are located at varying distances from the longitudinal axis of the heat source such that the first and second sides edges are configured to deflect heat to different sections of the cooking cavity.

In accordance with yet another aspect of the present invention, a cooking apparatus is provided. The cooking apparatus includes a cooking cavity; a heat source located within the cooking cavity; a shield mounted relative to the heat source, wherein the shield includes at least a first side edge and a second side edge opposite the first side edge, wherein the first side edge and the second side edge each include a convex portion and a concave portion, wherein the convex portion deflects heat emitted from the heat source to an outer section of a cooking cavity and the concave portion deflects heat emitted from the heat source to a central section of the cooking cavity.

To the accomplishment of the foregoing and related ends, the invention then, comprises the features hereinafter fully described. The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
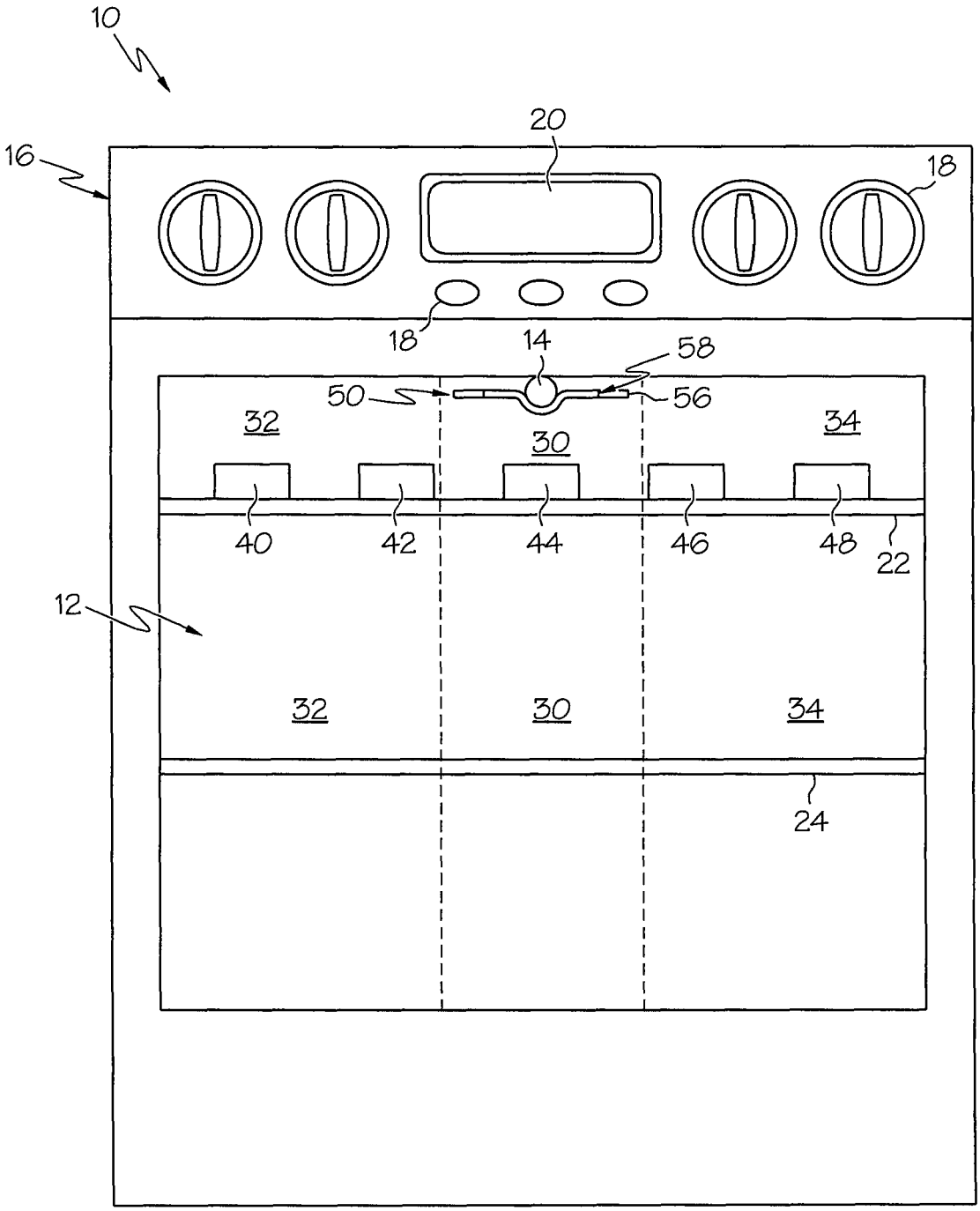
FIG. 1 is a front view of an example of a cooking apparatus with a heat source and a shield in accordance with an aspect of the present invention.

Example embodiments that incorporate one or more aspects of the present invention are described and illustrated in the drawings, in which like reference numerals are used to refer to like elements throughout. It is to be appreciated that the various drawings are not drawn to scale from one figure to another nor inside a given figure, and in particular that the size of the components are arbitrarily drawn to facilitate the reading of the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

As shown in FIG. 1, an example cooking apparatus is shown. The cooking apparatus can have a variety of embodiments and FIG. 1 is only one example of a cooking apparatus 10 that can be used. For instance, the present invention can be employed in a free-standing range, a wall oven, a toaster oven, and the like. The cooking apparatus 10 includes a cooking cavity 12 configured to support and cook food items therein. In this example, a heat source 14 is provided which can be located near the top of the cooking cavity 12 of the cooking apparatus 10. The cooking apparatus 10 can include a plurality of input devices 18 for operating the apparatus 10. The present example depicts button and knob input devices; however any suitable input device(s) can be provided. The input devices 18 are configured to allow a user to select different desired cooking temperatures and desired modes of cooking. The cooking cavity 12 is configured to support a plurality of cooking racks via built in oven glides or ladder rack structures, for example. FIG. 1 shows first and second racks 22, 24, which can be configured in any suitable manner. The heat source 14 can be a broil burner though other suitable types of heating elements can also be used.

The cooking cavity 12 can be divided up into a plurality of sections for purposes of the present application. For instance a central section 30 can be defined as the section positioned directly under the heat source 14. A first outer section 32 can be positioned on one side of the central section 30; and a second outer section 34 can be positioned on another side of the central section 30. A variety of food items 40, 42, 44, 46, 48 can be placed on the first rack 22, as shown in FIG. 1 and can be arranged such that at least one food item is located in the central section 30, at least one food item is located in the first outer section 32, and at least one food item is located in the second outer section 34.

In accordance with an aspect of the present invention, a heat shield 50 is positioned below a broiler heat source 14. The shield 50 can be constructed from one or more materials suitable for withstanding high temperatures associated with oven cooking temperatures, and more particularly broiler element temperatures. The shield 50 is configured to direct or deflect heat from the heat source 14 to various sections of the cooking cavity 12. Without the shield 50 of the present invention, radiant heat from the heat source 14 is directed downwards to the central section 30 of the cooking cavity 12, thereby overcooking food items placed on a central portion of the rack, and undercooking food items placed on outer portions of the rack. The shield 50 allows for the deflection of heat not only to the central section 30, but also to first and second outer sections 32, 34 of the cooking cavity.

Figure 2:
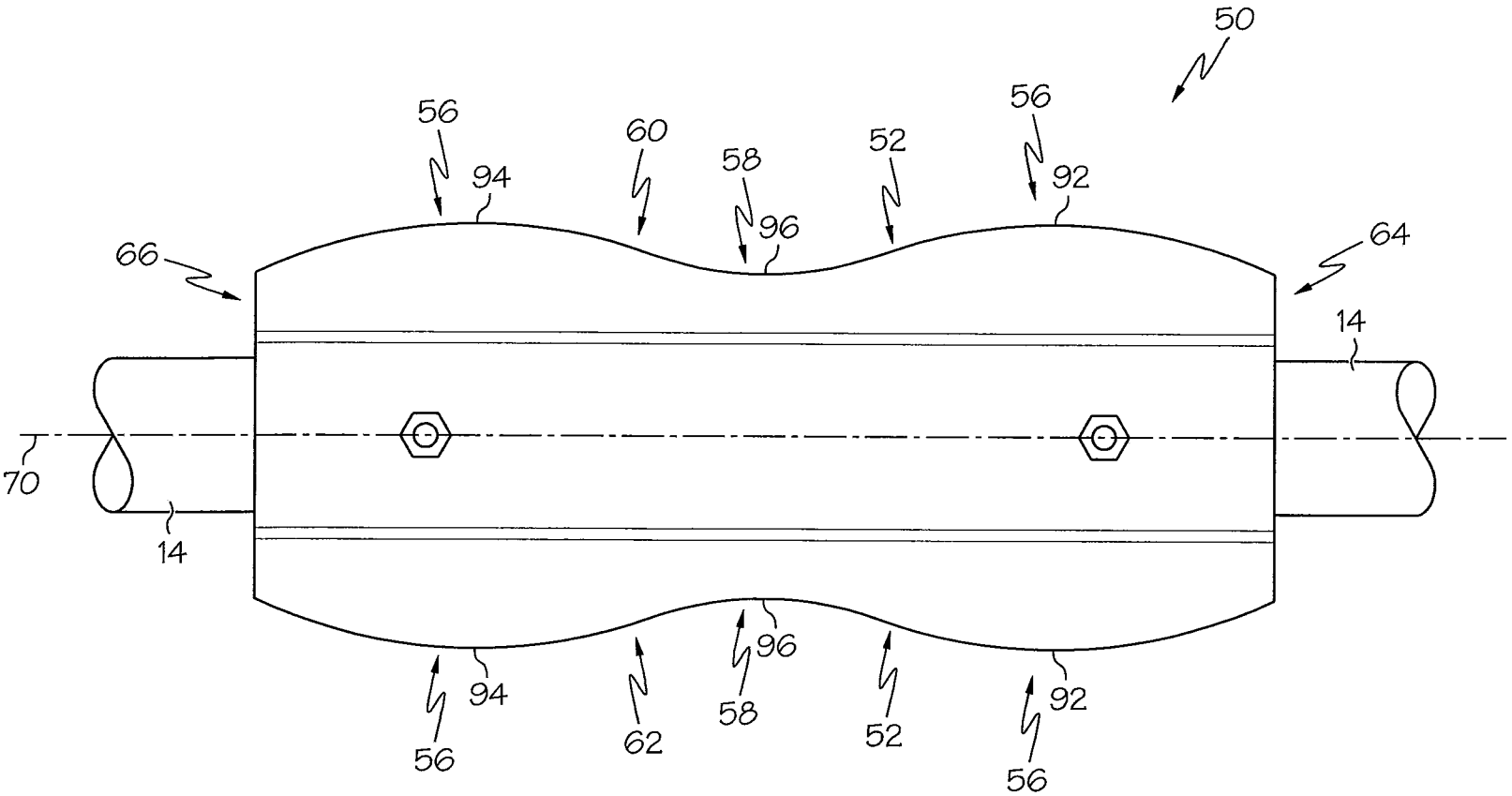
FIG. 2 is a top view of a heat source and shield in accordance with an aspect of the present invention.

FIG. 2 illustrates a configuration of the shield 50 in accordance with an aspect of the present invention. The shield 50 includes at least one, preferably two, undulating pattern(s) 52 along side edges 60, 62 of the shield 50. The undulating pattern(s) 52 is configured to deflect heat from the heat source 14 throughout the cooking cavity 12 in a substantially uniform manner. In the example shown in FIG. 2, the undulating pattern(s) 52 can include two convex portions 56, which operate to deflect heat to corresponding outer sections 32, 34 of the cooking cavity 12. A concave portion 58 is positioned between the two convex portions 56, such that the concave portion 58 is operable to direct heat to the central section 30 of the cooking cavity 12. Because the concave section 58 is positioned closer to the heat source 14, heat can travel relatively unrestricted down to the central section 30. The shield 50 further includes two end edges 64 and 66 positioned between the first and second side edges 60 and 62. As shown, the end edges 64, 66 have lengths of less than half the lengths of the first and second side edges 60, 62.

The first and second end edges 64, 66 are depicted as being linear-shaped; however it is to be appreciated that the first and second end edges 64, 66 can be of any desirable shape.

Although a specific configuration of the heat shield is shown and described in the present application, it is to be appreciated that a variety of other shapes for the outer surface configuration of the shield can be provided for directing uniform heat throughout the cooking cavity for substantially even cooking of food items. For instance, the peripheral configuration of the shield can various curve configurations, such as two concave portions and one convex portion, etc. The shield can also include straight portions along its side edges and/or various other geometries, such as triangular.

Figure 3:
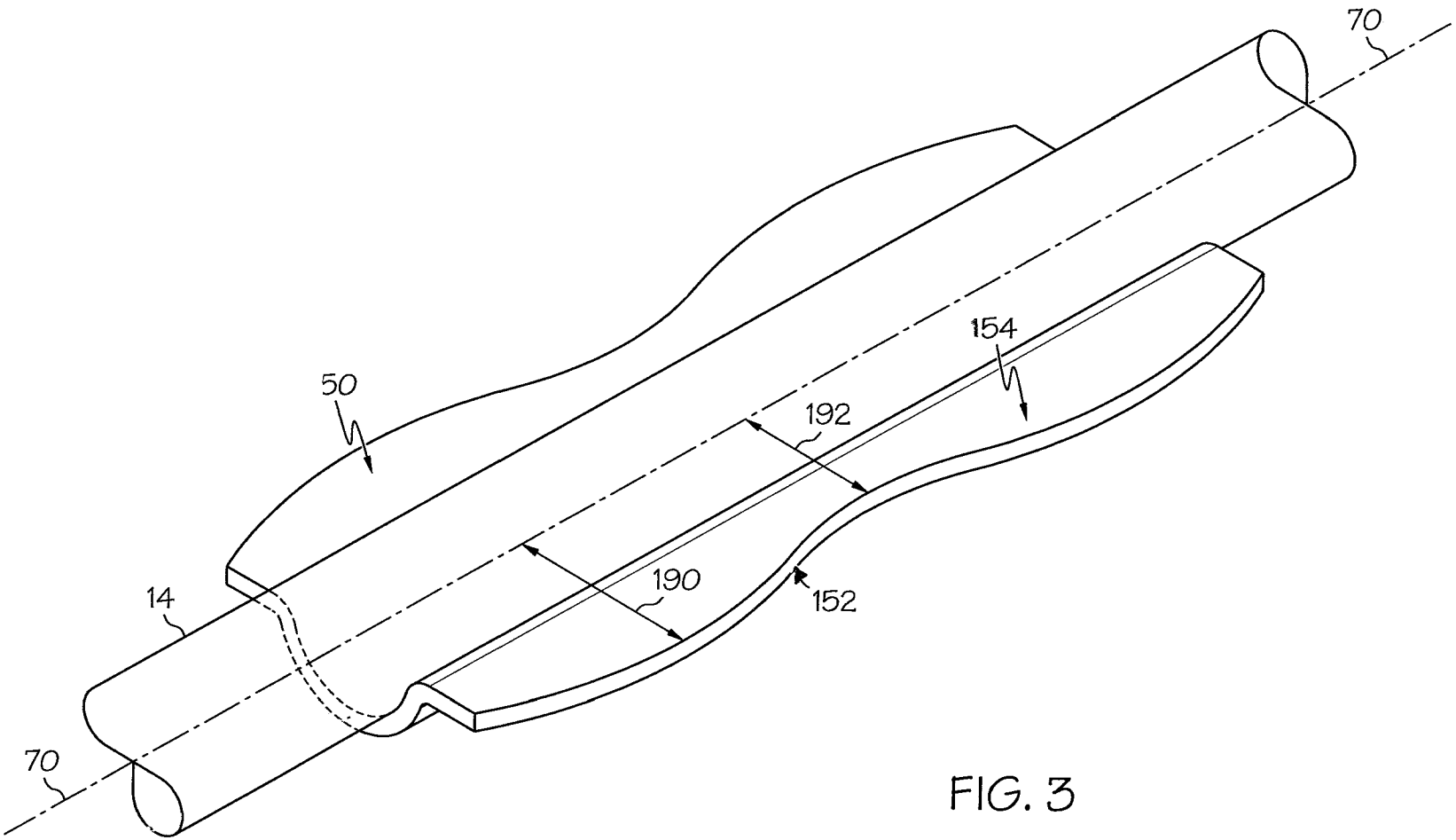
FIG. 3 is a bottom view of a heat source and shield in accordance with an aspect of the present invention.

The shield 50 and the heat source 14 are positioned proximate a top wall of the cooking cavity, as shown in FIG. 1 and can extend a substantial length between the rear to the front of the cooking cavity 12, as is conventional. The heat source 14 can be configured as a substantially longitudinal heating element and is positioned centrally and along the longitudinal axis of the shield 50. However, the heat source is not limited to a straight, longitudinal element, as depicted, and can be provided in a variety of shapes as desired. FIG. 3 illustrates an example of the shield 50 as positioned with respect to the heat source 14, in accordance with one aspect of the present invention. The shield 50 includes a bottom surface 152, which when positioned within the cavity 12 faces downward toward the interior of the cooking appliance 10 and a top surface 154, which when positioned within the cavity 12 faces a top wall of the cavity 12. A mid-section of the shield 50 can be recessed and shaped to receive a portion of the heating element therein. For instance, the recess can be a longitudinal channel of substantially the same curvature as the corresponding heating element. However, any suitable shape of the recess can be provided and is still contemplated as falling within the scope of the present invention. Moreover, the shield can be configured without a recess at all and be merely positioned below the heating element.

As discussed above, the side edges 60, 62 of the shield 150 can be located at varying distances 190, 192 from the longitudinal axis 70 of the heat source 14. The side edges 60, 62 are configured to deflect heat to different sections 30, 32, 34 of the cooking cavity 12. The wide portions of the shield 50, for instance that are located at greater distances (e.g., 190) from the longitudinal axis 70 of the heat source 14 are configured to deflect heat to an outer section 32, 34 of the cooking cavity 12; while the more narrow portions of the shield 50, for instance that are located at shorter distances (e.g., 192) from the longitudinal axis 70 of the heat source 14 are configured to deflect heat to a central section 30 of the cooking cavity 12. Thus, the shield 50 facilitates providing approximately evenly balanced heat throughout the cooking cavity 12.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations. For instance, the heat shield has been described herein as being used in conjunction with a broiler element; however it is to be appreciated that it can be used in other instances in which it is desired to deflect heat from a heating element substantially evenly in a cooking cavity.

What is claimed is:

1. A cooking apparatus comprising:

a cooking cavity;

a heat source located within the cooking cavity and configured to increase a temperature of the cooking cavity, wherein the heat source is a broiler element mounted to a top wall of the cooking cavity, and wherein the heat source extends along a longitudinal axis;

a shield mounted directly below the heat source, the shield having a top surface and a bottom surface, the top surface facing a top wall of the cooking cavity and the bottom surface facing into an interior of the cooking cavity, wherein the shield further includes a first side edge and a second side edge opposite the first side edge, at least one of the first and second side edges defining a sinusoidal pattern extending along a horizontal plane oriented along the longitudinal axis; and wherein the sinusoidal pattern is configured to deflect heat from the heat source to different sections of the cooking cavity; and wherein the shield further includes opposing first and second end edges positioned between the first and second side edges, the first and second end edges having lengths of less than half a length of the first and second side edges.

2. The cooking apparatus of claim 1, wherein the at least one of the first and second side edges includes a convex portion, wherein the convex portion is configured to deflect heat to an outer section of the cooking cavity located laterally to the side of the longitudinal axis.

3. The cooking apparatus of claim 1, wherein the at least one of the first and second side edges includes a concave portion, wherein the concave portion deflects heat to a central section of the cooking cavity located vertically below the longitudinal axis.

4. The cooking apparatus of claim 1, wherein the sinusoidal pattern includes at least two convex portions and one concave portion positioned between the two convex portions.

5. The cooking apparatus of claim 1, wherein the at least one of the first and second side edges includes a plurality of curves.

6. The cooking apparatus of claim 1, wherein the shield includes at least two opposing side edges having a sinusoidal pattern defining the side edges.

7. A cooking apparatus comprising:

a cooking cavity;

a heat source located within the cooking cavity and configured to increase a temperature of the cooking cavity, wherein the heat source is a broiler element mounted to a top wall of the cooking cavity;

a shield mounted directly below the heat source, wherein the shield includes a longitudinal axis, the shield having a top surface and a bottom surface, the top surface facing a top wall of the cooking cavity and the bottom surface facing into an interior of the cooking cavity;

wherein the shield further includes a first side edge and a second side edge opposite the first side edge, the first and second side edges located along a horizontal plane, wherein the first and second side edges each include a convex portion and a concave portion that are located, respectively, at varying distances from a vertical plane passing through the longitudinal axis of the shield such that the first and second sides edges are configured to deflect heat to different sections of the cooking cavity, wherein the concave portion deflects heat emitted from the heat source to a central section of the cooking cavity that is vertically below the longitudinal axis, and the convex portion deflects heat emitted from the heat source to an outer section of a cooking cavity located laterally to the side of the central section.

8. The cooking apparatus of claim 7, wherein the shield includes a recess formed therein for receiving a corresponding portion of the heat source.

9. The cooking apparatus of claim 8, wherein the recess is a longitudinal channel of substantially the same curvature as the heat source.

10. The cooking apparatus of claim 7, wherein the shield includes first and second end edges, the first and second end edges having lengths of less than half the lengths of the first and second side edges.

11. A cooking apparatus comprising:

a cooking cavity;

a heat source located within the cooking cavity and configured to increase a temperature of the cooking cavity, wherein the heat source is a broiler element mounted to a top wall of the cooking cavity, and wherein the heat source extends along a longitudinal axis;

a shield mounted directly below the heat source and extending along the longitudinal axis, wherein the shield includes a top surface facing a top wall of the cooking cavity, a bottom surface facing into an interior of the cooking cavity, at least a first side edge and a second side edge opposite the first side edge, wherein the first side edge and the second side edge each include convex portions alternating with a concave portion, wherein the concave and convex portions of the shield define a sinusoidal pattern along a horizontal plane oriented along the longitudinal axis, wherein the concave portion deflects heat emitted from the heat source to a central section of the cooking cavity and the convex portions deflect heat emitted from the heat source to an outer section of a cooking cavity located laterally to the side of the central section.

12. The cooking apparatus of claim 11, wherein the shield is configured such that heat emitted from the heat source is distributed substantially evenly throughout the cooking cavity.

13. The cooking apparatus of claim 11, wherein the first side edge and second side edge further includes two convex portions.

* * * * *